US010306373B2

(12) United States Patent
Chyzhov

(10) Patent No.: US 10,306,373 B2
(45) **Date of Patent: *May 28, 2019**

(54) ELECTROACOUSTIC TRANSDUCER WITH AXIAL ELECTRIC FIELD

(71) Applicant: AGA Ad Media, LLP, London (GB)

(72) Inventor: Maksym Viktorovich Chyzhov, Odessa (UA)

(73) Assignee: AGA AD MEDIA, LLP, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/006,195

(22) Filed: Jun. 12, 2018

(65) Prior Publication Data

US 2019/0110134 A1 Apr. 11, 2019

Related U.S. Application Data

(63) Continuation of application No. 15/726,664, filed on Oct. 6, 2017, now Pat. No. 10,021,492.

(51) Int. Cl.
*H04R 23/00* (2006.01)

(52) U.S. Cl.
CPC ..... *H04R 23/00* (2013.01)

(58) Field of Classification Search
CPC . G10K 15/06; G11B 7/00; H04R 9/08; H04R 19/02; H04R 23/00; H04R 23/004
USPC ..... 381/167
See application file for complete search history.

(56) References Cited

U.S. PATENT DOCUMENTS

| | | | | |
|---|---|---|---|---|
| 1,533,730 A | | 4/1925 | Engler | |
| 1,605,295 A | | 11/1926 | Shrader | |
| 1,687,011 A | | 10/1928 | Fleischmann | |
| 1,758,993 A | | 5/1930 | Wolff | |
| 3,476,887 A | * | 11/1969 | Seligson | H04R 23/004 381/167 |
| 3,716,828 A | | 2/1973 | Massa | |
| 4,204,244 A | | 5/1980 | Ho | |
| 4,460,809 A | * | 7/1984 | Bondar | H04R 23/004 381/111 |
| 4,706,228 A | | 11/1987 | Owen et al. | |
| 6,577,743 B2 | | 6/2003 | Masuda et al. | |

(Continued)

FOREIGN PATENT DOCUMENTS

UA 105621 C2 5/2014

*Primary Examiner* — Brian Ensey
(74) *Attorney, Agent, or Firm* — Finnegan, Henderson, Farabow, Garrett & Dunner LLP

(57) ABSTRACT

An electroacoustic transducer comprises a cathode having a plurality of cathode discharge elements in an array disposed around an axis associated with the cathode; an anode having a plurality of anode discharge elements in an array disposed around an axis associated with the anode; an inter-electrode space separating the cathode and the anode; and a current-limiting element configured to limit current supplied to at least one of the cathode or the anode when connected to the voltage source. The cathode discharge elements and anode discharge elements extend toward the inter-electrode space. The respective arrays of the cathode and anode are opposite of each other with respect to the inter-electrode space and are axisymmetric such that the cathode axis is aligned with the anode axis. At least one of the cathode and anode is configured to generate the acoustic signal when connected to a voltage source through the current-limiting element.

20 Claims, 10 Drawing Sheets

(56) References Cited

U.S. PATENT DOCUMENTS

| | | | |
|---|---|---|---|
| 7,010,342 | B2 | 3/2006 | Galen et al. |
| 7,190,242 | B2 | 3/2007 | Takamine |
| 8,085,957 | B2 | 12/2011 | Shishov et al. |
| 8,831,248 | B2 | 9/2014 | Mellow et al. |
| 9,025,798 | B2 | 5/2015 | Saint Vincent et al. |
| 9,445,202 | B1 * | 9/2016 | Chyzhov ..... H04R 23/004 |
| 2009/0022340 | A1 | 1/2009 | Krichtafovich et al. |
| 2015/0117692 | A1 | 4/2015 | Akino |

* cited by examiner

ELECTROACOUSTIC TRANSDUCER WITH AXIAL ELECTRIC FIELD

RELATED APPLICATIONS

This application is a continuation of U.S. application Ser. No. 15/726,664, filed Oct. 6, 2017, the content of which is hereby incorporated in its entirety.

TECHNICAL FIELD

The present disclosure relates to the field of acoustics and, more particularly, to the creation of acoustic waves in a gaseous medium, such as air, to reproduce acoustic waves, including those perceived by the human ear, for domestic, scientific, and industrial purposes.

BACKGROUND

Electroacoustic transducers, such as loudspeakers, are devices that convert electrical energy into acoustic oscillations. Electroacoustic transducers are utilized in many consumer products, such as household stereo systems, home theater systems, audio systems for automobiles, portable music devices, headphones, recording studio equipment, acoustic sensory equipment, and others. Demand for high quality sound production and/or recording from these and other products has generated great interest in the development of electroacoustic transducers that can convert electronic signals into sound waves with greater accuracy and higher definition.

One problem with known electroacoustic transducers is their reliance on moving components (e.g., voice coils and diaphragms) to produce acoustic oscillations in a two-step energy conversion process. In the first step, electric energy of a sound signal is converted into mechanical vibrations of a membrane attached to the electro acoustic transducer. In the second step, the mechanical vibrations of the membrane create acoustic oscillations in a surrounding gas medium (e.g., air). The membrane has a certain mass, a finite, limited rigidity, and given boundaries, which affect the quality of sound reproduced in the surrounding space during the second step. Thus, the quality of sound reproduction is physically limited by these aspects of the membrane. Some manufacturers have sought to overcome these challenges by producing different types of electroacoustic transducers that operate without the use of moving parts. For example, electroacoustic devices have been developed that create sound waves using areal electric discharge.

U.S. Pat. No. 9,445,202 to Chyzhov (hereby incorporated by reference) describes an electroacoustic transducer that includes an anode and a cathode, each including discharge elements. One or both of the electrodes (i.e., the anode and cathode) are separated into sections by dielectric barriers. Corresponding discharge elements of the cathode and anode are positioned opposite each other, their terminal ends extending equidistantly into a space between the cathode and the anode (i.e., an inter-electrode space). An active surface area (S) of the discharge elements of the anode and cathode satisfy the expression $S_{anode}/S_{cathode}>1$. The discharge elements are configured as discrete or solid bodies with a linear cross-sectional length not greater than 3 mm. The electrode sections are separated from one another by dielectric barriers connected to a voltage source through a current-limiting element (i.e., a resistor).

While the electroacoustic transducer of the '202 patent may be operable to create sound waves, further improvements may be realized. For example, one problem experienced in the operation of electroacoustic transducers utilizing electrical discharge to create acoustic waves is that the stability of the discharge process may be reduced when the power output of the generated acoustic signal is increased during operation of the device. Accordingly, there is a need for improved electroacoustic transducers having improved efficiency and increased stability of the discharge process.

SUMMARY

Embodiments disclosed herein may achieve increased efficiency while simultaneously eliminating the negative impact of the barriers on the stability of the discharge process of electroacoustic transducers. As a result, the disclosed embodiments may provide for an increase in the stability of the discharge process and power output of acoustic signals generated during operation of electroacoustic transducers consistent with this disclosure.

In one aspect, the present disclosure is directed to an electroacoustic transducer. The electroacoustic transducer may include a cathode having a plurality of discharge elements assembled into one or more axisymmetric arrays and an anode having a plurality of discharge elements assembled into one or more axisymmetric arrays. The cathode and the anode may be separated by an inter-electrode space and respectively connected to a voltage source. The discharge elements of the cathode and anode may be directed into the inter-electrode space. The axisymmetric arrays of the cathode and anode may be mirror symmetrically arranged opposite each other to form electrode pairs, each electrode pair having an axis of symmetry extending through the geometric centers of the axisymmetric arrays in the pair.

In another aspect, the present disclosure is directed to an electroacoustic transducer, wherein the discharge elements of the anode have a first active surface area (San), the discharge elements of the cathode have a second active surface area (Scat), and a ratio of the first surface area to the second surface area is greater than one (San/Scat>1).

In another aspect, the present disclosure is directed to an electroacoustic transducer wherein the axisymmetric arrays have a diameter not greater than 20 mm.

In another aspect, the present disclosure is directed to an electroacoustic transducer wherein the cathode is connected to a voltage source by a first circuit portion, the anode is connected to the voltage source by a second circuit portion; and one or both of the first and second circuit portions includes a current-limiting element.

In another aspect, the present disclosure is directed to an electroacoustic transducer wherein the discharge elements are at least partially embedded in a dielectric material.

In another aspect, the present disclosure is directed to an electroacoustic transducer wherein terminal ends of the discharge elements of each array extend to a virtual surface.

In another aspect, the present disclosure is directed to an electroacoustic transducer wherein the virtual surface is a virtual plane, or a virtual curved surface.

In another aspect, the present disclosure is directed to an electroacoustic transducer wherein the virtual curved surface is a virtual axisymmetric curved surface.

In another aspect, the present disclosure is directed to an electroacoustic transducer wherein the discharge elements are solid three-dimensional bodies.

In another aspect, the present disclosure is directed to an electroacoustic transducer wherein the discharge elements are solid three-dimensional bodies with alternating conduction and dielectric areas.

In another aspect, the present disclosure is directed to an electroacoustic transducer wherein the discharge elements comprise corrosively or electrochemically inert materials.

In another aspect, the present disclosure is directed to an electroacoustic transducer wherein the discharge elements comprise one or more of platinum-group metals, metal oxides, or combinations thereof.

In another aspect, the present disclosure is directed to an electroacoustic transducer wherein the discharge elements comprise materials with a low or a high electron work function.

In another aspect, the present disclosure is directed to an electroacoustic transducer further comprising a plurality of pairs of electrodes assembled on a dielectric base.

In another aspect, the present disclosure is directed to an electroacoustic transducer wherein adjacent electrode pairs are separated by an insulator.

In another aspect, the present disclosure is directed to an electroacoustic transducer further including a reflector or a horn located near or around the electrode pairs.

In another aspect, the present disclosure is directed to an electroacoustic transducer further including a sound-penetrable material with high resistance to airflow that at least partially surrounds the discharge elements.

In another aspect, the present disclosure is directed to an electroacoustic transducer further comprising a ventilation system.

In another aspect, the present disclosure is directed to an electroacoustic transducer wherein the ventilation system comprises an ozone-decomposition catalyst.

In another aspect, the present disclosure is directed to an electroacoustic transducer wherein the ventilation system includes one or more fans.

BRIEF DESCRIPTION OF THE DRAWINGS

The accompanying drawings, which constitute a part of this specification, illustrate several embodiments and, together with the description, serve to explain the disclosed principles.

DETAILED DESCRIPTION

Figure 1:
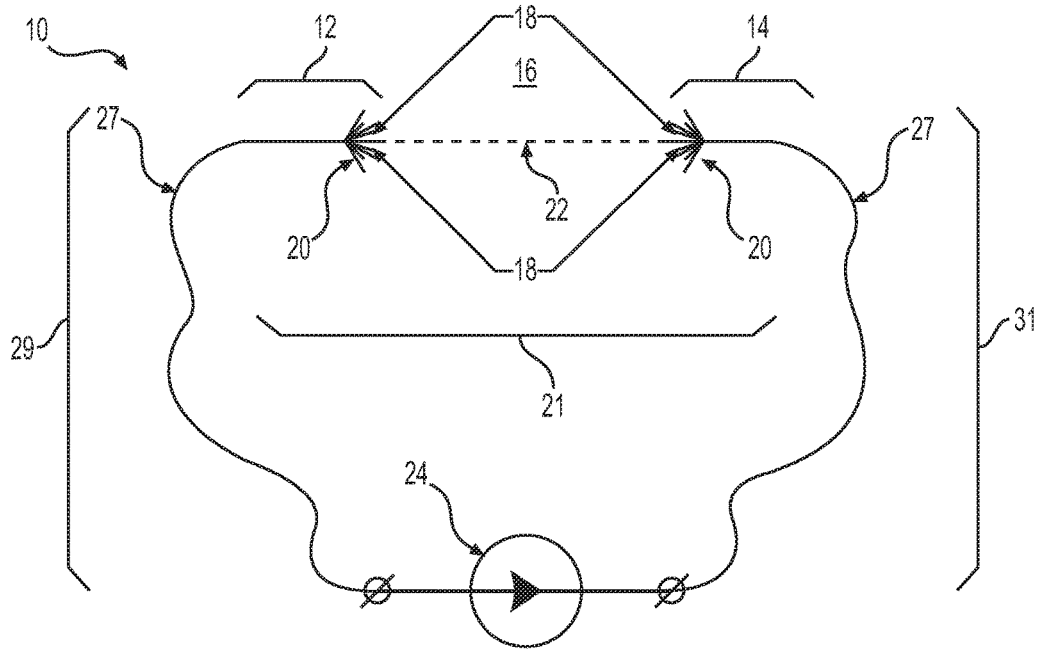
FIG. 1 is a schematic circuit diagram showing electrodes connected to a voltage source.

FIG. 1 illustrates an exemplary disclosed circuit 10 that may be included in embodiments of exemplary electroacoustic transducers consistent with this disclosure. Exemplary electroacoustic transducers consistent with this disclosure may include two electrodes, for example, a cathode 12 and an anode 14, separated by an inter-electrode space 16. The inter-electrode space 16 may be a space that at least partially separates the cathode 12 (or components thereof) from the anode 14 (or components thereof) such that direct contact between a terminal end of the cathode 12 and a terminal end of the anode 14 (or of their respective components) does not occur through or within the inter-electrode space 16.

The cathode 12 and anode 14 may each include a plurality of discharge elements 18. Discharge elements 18 may be electrically conductive elements that extend from the cathode 12 or anode 14 into the inter-electrode space 16. For example, discharge elements 18 may be formed of copper, aluminium, steel, another conductive material, or combinations thereof. Discharge elements 18 may include a first end attached to the cathode 12 or anode 14 and a second terminus end (i.e., a terminal or terminal end) that is positioned in the inter-electrode space 16. Discharge elements 18 may provide a site (e.g., a surface area) on or around which aerial electric discharge (e.g., corona discharge) is formed or generated when an electric potential (i.e., a voltage) is applied between the cathode 12 and anode 14. For example, the discharge elements 18 may have a large surface curvature, which creates a high electric field intensity near the discharge elements 18 when energized. When the electroacoustic transducer is energized (i.e., when a voltage potential is applied to the electrodes), an active region forms on each discharge element of the cathode 12 and the anode 14. As used herein, the term "active region"

refers to an area (e.g., a surface area) of each discharge element 18 that directly participates in ion generation. An area that directly participates in ion generation, i.e., the active region, may be identified as a surface area that is surrounded by a glow of ionized gas when the electroacoustic transducer is energized (i.e., when a voltage potential is applied to the cathode 12 and anode 14). When the electroacoustic transducer is energized, the active region forms on a surface area of each discharge element 18. This surface area of each discharge element on which the active region may form may be referred to as a "discharge element area" or "discharge area." When the electroacoustic transducer is not energized, the discharge element area may be identified as a portion of a discharge element that protrudes from an electrode, is flush with the electrode, or is otherwise visibly exposed.

In some embodiments, electrodes of an electroacoustic transducer may be configured to exhibit a ratio of a surface area (San) of anode 14 to the surface area (Scat) of cathode 12 that is greater than 1 (i.e., San/Scat>1). In other words, the surface area of anode 14 may be greater than the surface area of cathode 12. The respective surface areas of the cathode 12 and the anode 14 may be the cumulative surface areas of the one or more discharge elements 18 associated with each respective electrode (i.e., each respective array 20 of an electrode pair). In some embodiments, each discharge element 18 of an electrode may be the same size, about the same size, or a different size such that undesirable arc or spark discharge (and resulting sound effects and distortions) are avoided.

Maintaining a ratio of San/Scat>1 may allow for more efficient recombinations of ions of opposite signs near discharge elements 18 during the coronal discharge process even as the voltage between cathode 12 and anode 14 is modulated. Configuring the electrodes of an electroacoustic transducer with a ratio of San/Scat>1 may allow a high acoustic power density to be produced (i.e., high-volume sound production), while preserving the spatial and temporal stability of the coronal discharge (e.g., reduction or elimination of arc and/or spark breakdown and hissing and/or crackling).

For instance, cations are produced by shock ionization in the active region of the discharge elements 18 within the coronal discharge. The intensity of ion generation depends on the intensity of the electric field generated between the electrodes, as well as on the size of the discharge element area that forms the active region of the discharge elements 18. Anions arise as a consequence of the trapping of free electrons emitted by the cathode 12 due to autoelectronic emissions, which occur in the space between the electrodes. In that space, the current emission density may attain a relatively large value (e.g., up to 1010 A/cm$^2$ in vacuum). Thus, the speed of anion generation is inversely proportional to the area of the discharge element of the cathode 12. When the San/Scat ratio≤1 and depending on the form and arrangement of the discharge electrodes, the discharge process can be either very weak (i.e., insufficient for proper sound generation) or unstable, as the balance of the generated anions and cations may be disturbed. Such disturbance can cause discharge instability, acoustic distortion, and arc or spark breakdown. When San/Scat>1, these deficiencies may be avoided.

In some embodiments, San/Scat may be greater than 1. For example the electrodes of an electroacoustic transducer may be configured to exhibit 25≥San/Scat>1 (e.g., 20≥San/Scat>1; 15≥San/Scat>1; 10≥San/Scat>1; 9≥San/Scat>1; 8≥San/Scat>1; 7≥San/Scat>1; 6≥San/Scat>1; 5≥San/Scat>1, 4≥San/Scat>1; 3≥San/Scat>1). In some embodiments the electrodes of an electroacoustic transducer may be configured to exhibit 20≥San/Scat≥2 (e.g., San/Scat=6). That is, the ratio of San to Scat may be between 2 and 20, inclusive. As used herein, the term "inclusive," when used with reference to ranges of values, is intended to include the endpoint values of the range. It is understood that other San/Scat values may be tested and implemented than those listed above.

In some embodiments, discharge elements 18 may comprise materials having a relatively high or relatively low work function to allow greater ion generation. For example, discharge elements 18 may comprise materials having a work function no greater than 4.5 eV. However, it is understood that discharge elements may comprise materials having a higher or lower work function.

Discharge elements 18 of the cathode 12 and anode 14 may be assembled into axisymmetric arrays 20. Each array 20 of discharge elements 18 may be a group of (e.g., a plurality of) discharge elements arranged together on the cathode 12 or anode 14. The cathode 12 and anode 14 may be configured such that arrays 20 of the cathode 12 and anode 14 form pairs 21 of arrays 20 that share an axis of symmetry 22 (e.g., pairs 21 comprising one array 20 of the cathode 12 and one array 20 of the anode 14 that share axis of symmetry 22). Each array 20 of discharge elements 18 may be connected to a voltage source 24 via a conductor 27 to form a circuit portion, e.g., a first circuit portion 29 connecting the cathode 12 to the voltage source 24 and a second circuit portion 31 connecting the anode 14 to the voltage source 24. The voltage source 24 may be configured to provide a potential difference (i.e., a voltage) across the cathode 12 and anode 14. The voltage generated by the voltage source 24 may be modulated and applied to the cathode 12 and anode 14 via a conductor 27 (e.g., a wire).

As used herein, the term "axisymmetric array" refers to the implementation of a plurality of discharge elements 18 as an electrode (i.e., the anode 1, cathode 2), wherein the discharge elements 18 include active areas (i.e., areas having a large surface curvature that becomes surrounded by a glow of ionized gas, which emerges with the application of voltage across the electrodes during the operation of the electroacoustic transducer) and are arranged in a confined spatial area having a symmetrical shape with respect to an axis extending through the anode 12 and cathode 14. In other words, the discharge elements 18 of the cathode 12 and the anode 14 are arranged symmetrically into separate arrays 20 about a common axis of symmetry 22. Arrays 20 of the cathode 12 and anode 14 that share an axis of symmetry 22 form an axially symmetric (or axisymmetric) pair 21 of arrays 20. Arranging the discharge elements 18 into axisymmetric arrays 20 provides a highly effective solution to the posed problem, i.e., stabilization of the electric discharge process that occurs during operation of electroacoustic transducers. This solution may be realized by configuring the geometry of the electrodes (i.e., the arrays 20 of the cathode 12 and the anode 14) according to the specific parameters of the discharge process. Such parameters include the applied voltage potential, the modulation signal, the size of the inter-electrode space 16, the surface area of each discharge element 18, and the spacing among the discharge elements 18 within an array 20.

Figure 2:
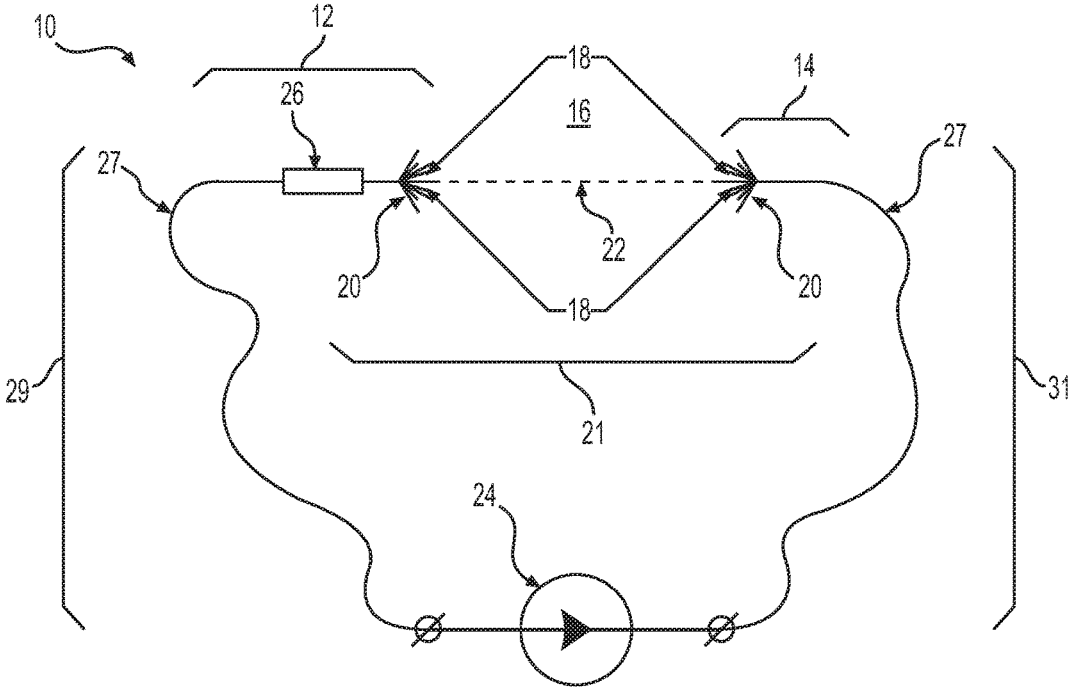
FIG. 2 is a schematic circuit diagram showing electrodes connected to a voltage source, and a current-limiting element in the cathode circuit.
Figure 3:
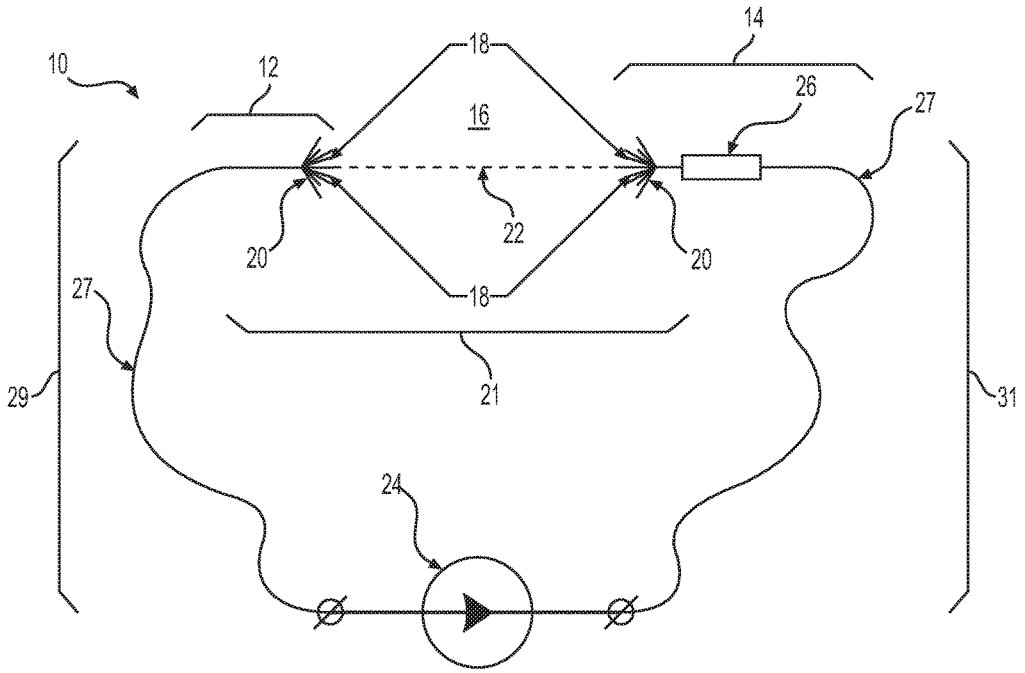
FIG. 3 is a schematic circuit diagram showing electrodes connected to a voltage source, and a current-limiting element in the anode circuit.
Figure 4:
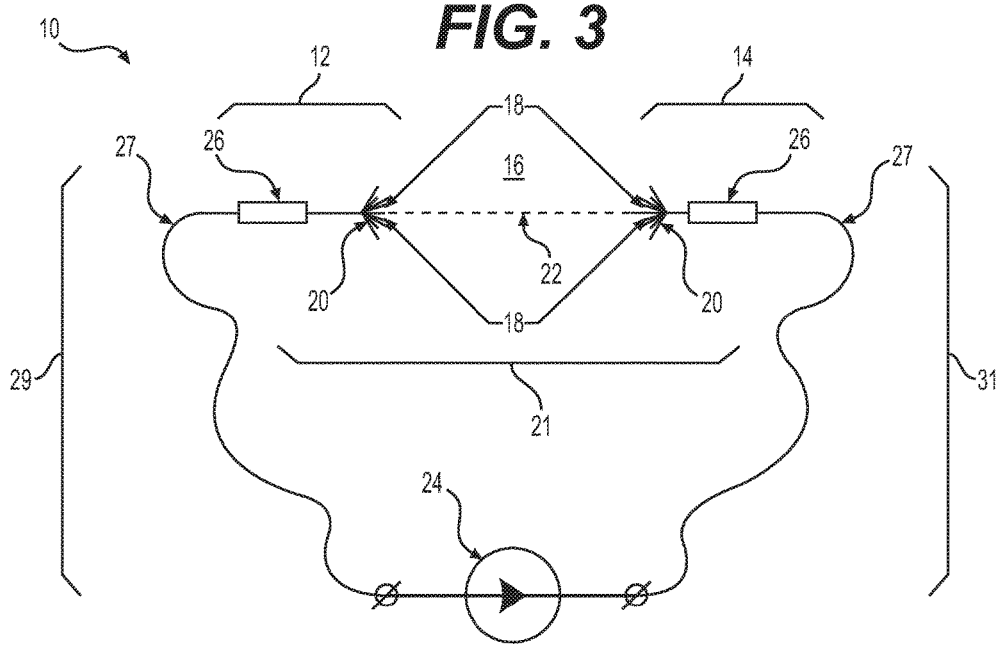
FIG. 4 is a schematic circuit diagram showing electrodes connected to a voltage source, and a current-limiting element in the cathode and anode circuit.

In some embodiments, as shown in FIGS. 2-4, one or more electrodes (i.e., the cathode 12 and/or anode 14) may be connected to the voltage source 24 through a current-limiting element 26. Current limiting elements 26 may include resistors (e.g., comprising carbon, graphite, metal oxide, wound wire, semiconductors, etc.) or other device(s) configured to control, attenuate, reduce, or limit current flow. For example, in the embodiment shown in FIG. 2, the cathode 12 may be connected to the voltage source 24 through a current limiting element 26, while the cathode 14 may be connected to the voltage source 24, but not through a current limiting element. In other embodiments, for example, as shown in FIG. 3, the anode 14 may be connected to the voltage source 24 through a current limiting element 26, while the cathode 12 may be connected to the voltage source 24, but not through a current limiting element. In yet other embodiments, for example, as shown in FIG. 4, the cathode 12 and the anode 14 may each be connected to the voltage source 24 through a separate current limiting element 26. Current limiting elements 26 may allow the electroacoustic transducer to operate at higher voltages without undesired arc or spark discharge by preventing the electrodes from receiving an over-voltage (i.e., an excessively high voltage) from the voltage source 24.

With reference to FIGS. 5-14, the axisymmetric array 20 of discharge elements 18 of each electrode (i.e., the cathode 12 and anode 14) may be mounted on a dielectric base 28. The axisymmetric array 20 may be configured to achieve high stability of electric discharge during operation of the electroacoustic transducer. For example, the discharge elements 18 forming the axisymmetric array 20 may be arranged such that terminal ends of the discharge elements 18 generally form, follow, or correspond to a shape, such as a plane, a hemisphere, or another shape. Terminal ends of discharge elements 18 "generally" form, follow, or correspond to a shape where the discharge elements 18 are arranged such that the shape would be formed by connecting the terminal ends of the discharge elements 18 with a virtual line or surface, such as a virtual curved surface or a virtual axisymmetric curved surface.

Figure 5:
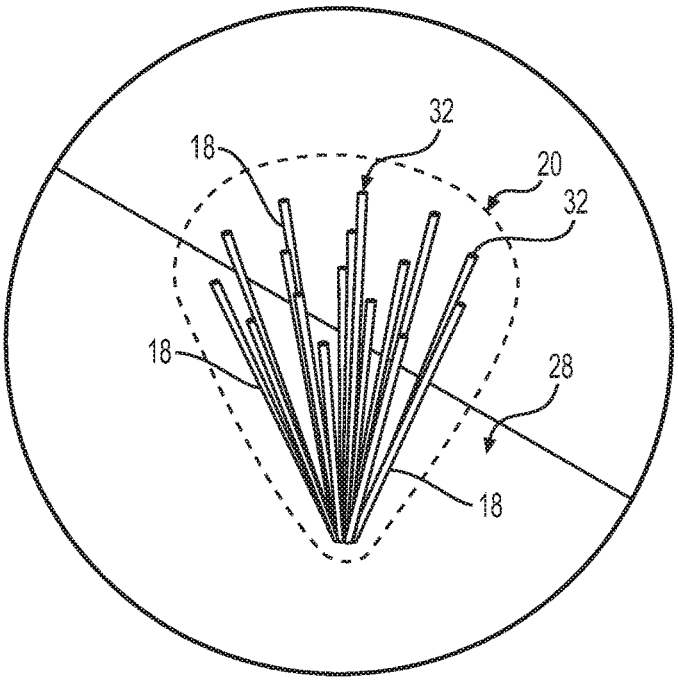
FIG. 5 is a perspective view of an exemplary disclosed embodiment of a discharge element array with discharge element terminals extending to a virtual plane.
Figure 6:
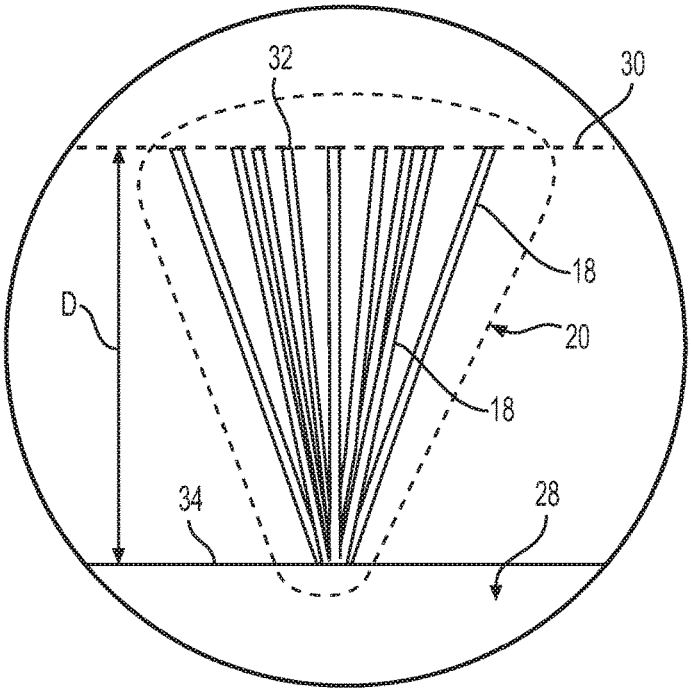
FIG. 6 is a side view of the exemplary disclosed embodiment of FIG. 5.

For example, FIGS. 5 and 6 show exemplary embodiments of an axisymmetric array 20 of discharge elements 18 in which the discharge elements 18 extend from the dielectric base 28 to a virtual plane 30 (i.e., one example of a virtual shape). Virtual plane 30 may be a non-existent (or imaginary) plane or surface that corresponds to an area of space that is a predetermined normal distance D from a surface (or a point on the surface) of dielectric base 28. Discharge elements 18 extend to the virtual plane 30 by extending from dielectric base 28 to the area of space that is a normal distance D from the surface (or a point on the surface) of dielectric base 28. As shown in FIG. 6, a terminus (or a terminal end) 32 of each discharge element 18 is located a normal distance D from a point on a surface 34 of dielectric base 28, and thus each discharge element 18 extends to virtual plane 30. In other embodiments, the virtual plane 30 may be at an angle with respect to the surface 34 of the dielectric base 28. For example, each point on the virtual plane 30 may not be the same normal distance from the surface 34 of the dielectric base 28, and the virtual plane 30 may instead be any virtual plane in space to which the terminal ends 32 of the discharge elements 18 extend.

Figure 7:
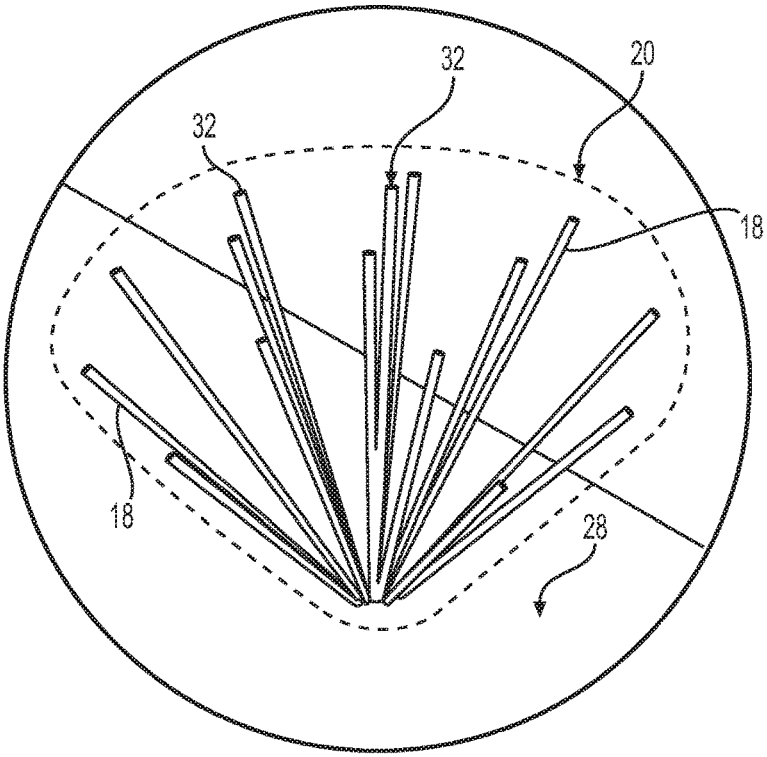
FIG. 7 is a perspective view of another exemplary disclosed embodiment of a discharge element array with terminals extending to a virtual hemisphere.
Figure 8:
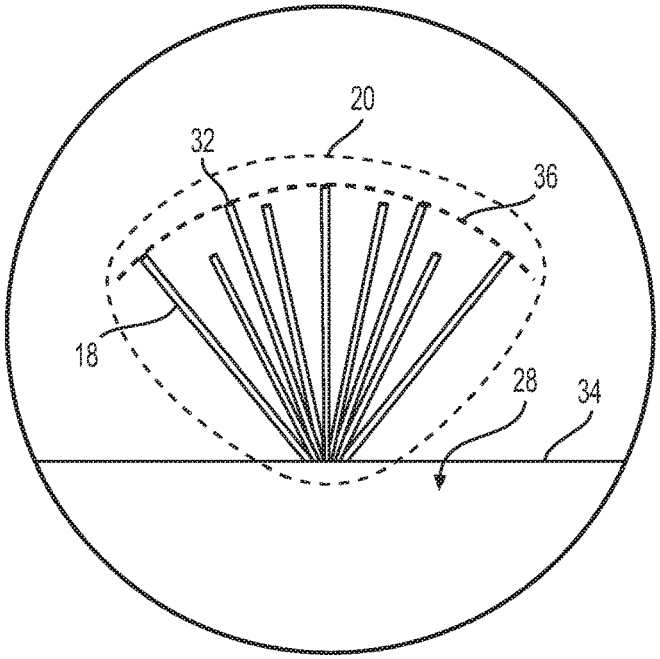
FIG. 8 is a side view of the exemplary disclosed embodiment of FIG. 7.

FIGS. 7 and 8 show exemplary embodiments of an axisymmetric array 20 of discharge elements 18 in which the discharge elements 18 extend from the dielectric base 28 to a virtual hemisphere 36. Virtual hemisphere 36 may be a non-existent (or imaginary) surface that corresponds to an area of space that follows the shape of a hemisphere to which the terminal end 32 of each discharge element 18 extends. Discharge elements 18 extend to the virtual hemisphere 36 by extending from dielectric base 28 to the area of space that corresponds to a location on the virtual hemisphere 36. As shown in FIG. 8, the terminal end 32 of each discharge element 18 is located on the virtual hemisphere 36, and thus each discharge element 18 extends to the virtual hemisphere 36.

It is to be appreciated that shapes formed by, followed, by, or that correspond to the terminal ends 32 of the discharge elements 18 may not necessarily be perfectly formed by the discharge elements. That is, the discharge elements 18 may not form a perfectly flat plane, a perfectly round hemisphere, etc. Rather, it is to be appreciated that the shape formed by the terminal ends 32 of the discharge elements 18 is a shape that a person of ordinary skill in the art would recognize to be or to resemble the general form of a known shape. It is also to be appreciated that other shapes may be formed by discharge elements 18, which may be identified through experimentation.

In some embodiments, the dielectric base 28 may be a component of an electroacoustic transducer, such as a frame, a body component, or another type of component. In some embodiments, the dielectric base 28 may also be an insulator for conductors 27 that connect the cathode 12 and anode 14 to the voltage source 24. That is, conductors 27 may be located at least partially within (or enclosed by) dielectric base 28, and the dielectric base 28 may insulate the conductors 27 electrically and from contact with other components.

Figure 9:
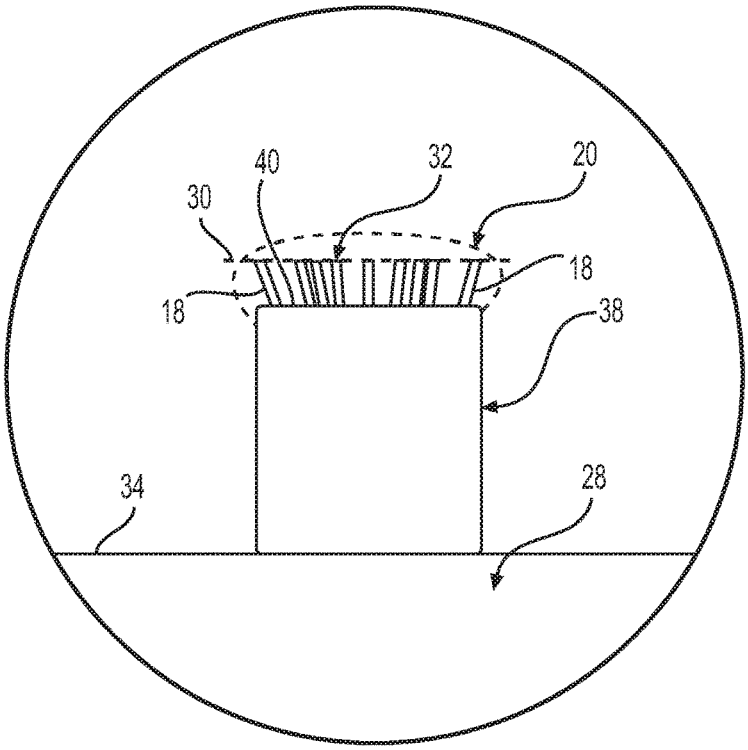
FIG. 9 is a side view of an exemplary disclosed embodiment of a discharge element array having discharge elements with terminals extending to a virtual plane, that are embedded in a dielectric, and protrude above a surface of the dielectric.
Figure 10:
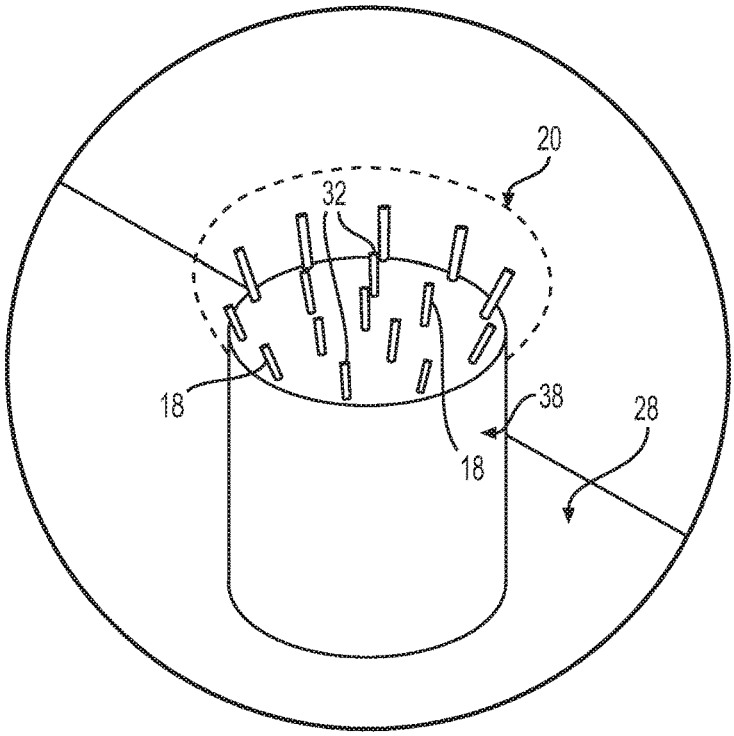
FIG. 10 is a perspective view of the exemplary disclosed embodiment of FIG. 9.
Figure 11:
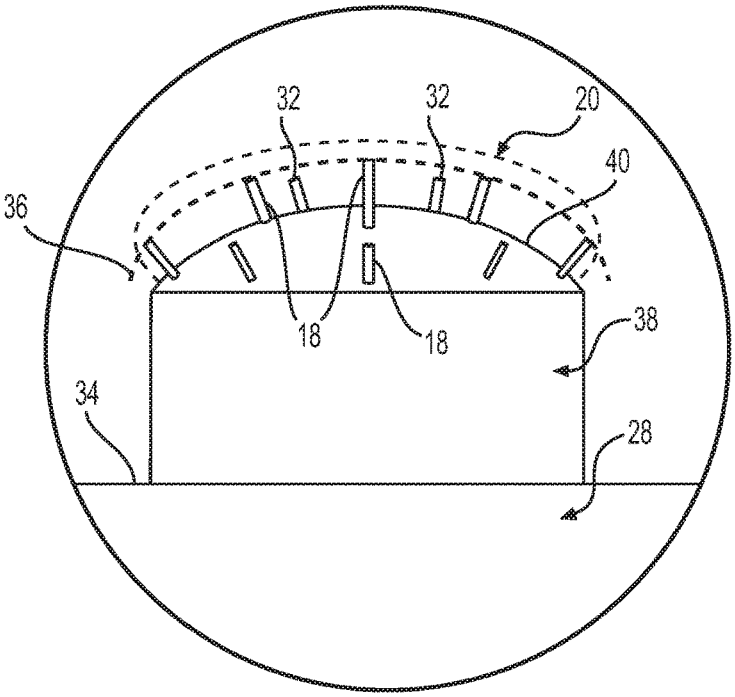
FIG. 11 is a side view of an exemplary disclosed embodiment of a discharge elements array having discharge elements with terminals extending to a virtual hemisphere, that are embedded in a dielectric, and protrude above a surface of the dielectric.
Figure 12:
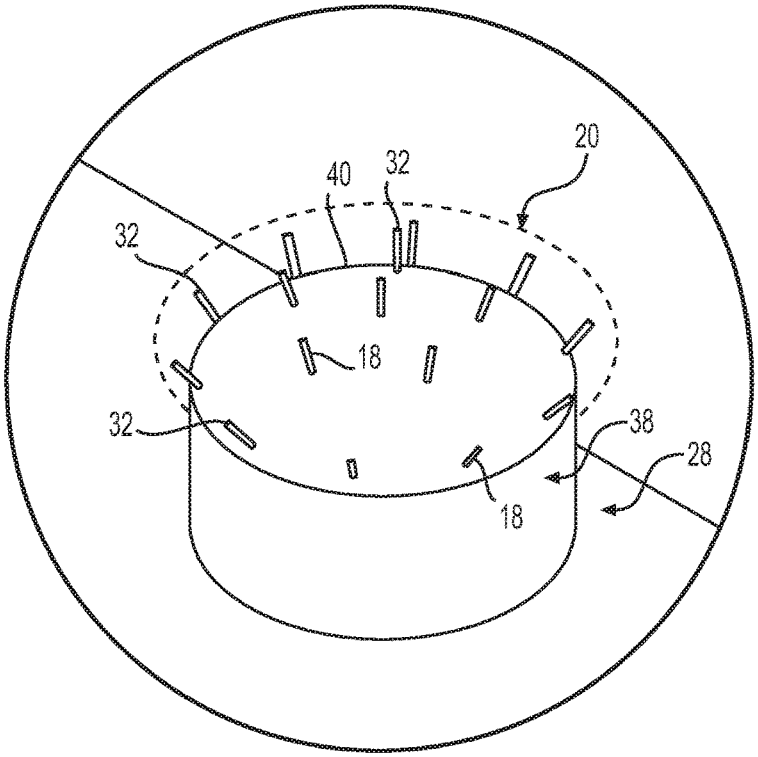
FIG. 12 is a perspective view of the exemplary disclosed embodiment of FIG. 11.

In some embodiments, as shown in FIGS. 9 and 10, the discharge elements 18 may be attached to, coated with, surrounded by, or at least partially embedded within a dielectric compound 38 (i.e., a dielectric coating, potting, casting or other element or component separate from the dielectric base 28) on top of the dielectric base 28. Dielectric compound 38 may be a component formed of a dielectric material configured to at least partially surround the discharge elements 18 atop dielectric base 28, for example, to structurally stabilize the discharge elements 18 minimize the dust accumulation rate between the discharge elements 18 in the arrays 20, and simplify the installation and removal processes of the arrays 20. In this way, implementation of the dielectric compound 38, as described herein above, may improve the operating characteristics of the device and provide greater flexibility in design and manufacturing/assembly processes. In the embodiments of FIGS. 9 and 10, the discharge elements 18 may be at least partially surrounded by dielectric compound 38 and extend to virtual plane 30. In other embodiments, as shown in FIGS. 11 and 12, the discharge elements 18 of axisymmetric array 20 may be at least partially surrounded by dielectric compound 38 atop dielectric base 28 and extend to virtual hemisphere 36. It should be appreciated that discharge elements 18 at least partially surrounded by dielectric compound 38 may extend to other types of virtual shapes.

In the embodiments shown in FIGS. 9-12, the terminal ends 32 of the discharge elements 18 may extend through the dielectric compound 38. For example, the terminal ends 32 of the discharge elements 18 may extend through the dielectric compound 38 such that the terminal end 32 of one or more discharge element 18 extends beyond a surface or exterior of the dielectric compound 38. The length of a discharge element 18 extending out of the dielectric compound 38 may affect the size of the active area of the discharge element 18, i.e., the surface area of the discharge element 18 that participates in ion generation during operation of the electroacoustic transducer.

Figure 13:
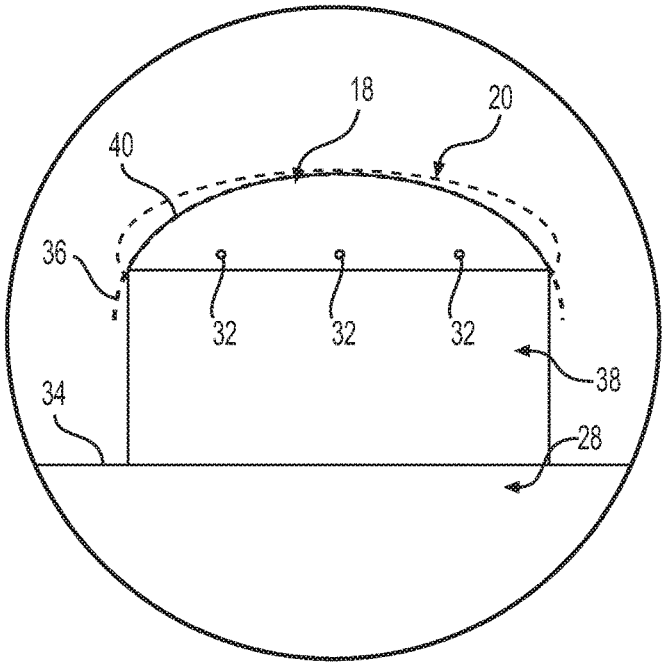
FIG. 13 is a side view of an exemplary disclosed embodiment of a discharge element array having discharge elements with terminals extending to a virtual hemisphere, that are embedded in a dielectric, and are level with a surface of the dielectric.
Figure 14:
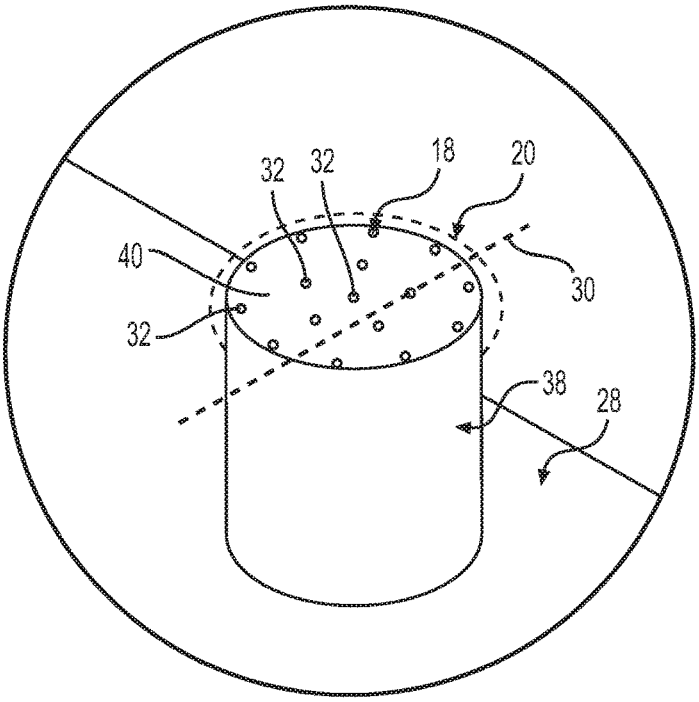
FIG. 14 is a perspective view of an exemplary disclosed embodiment of a discharge element array having discharge elements with terminals extending to a virtual plane, that are embedded in a dielectric, and are level with a surface of the dielectric.

In other embodiments, as shown in FIGS. 13 and 14, the terminal ends 32 of the discharge elements 18 may be embedded within the dielectric compound 38. In some embodiments, the terminal ends 32 of the discharge elements 18 may be flush or even with an outer surface of the dielectric compound 38 while also extending to a virtual shape. For example, as shown in FIG. 13, the terminal ends 32 of discharge elements 18 may extend to and be flush or even with an outer surface 40 of dielectric compound 38. In the example of FIG. 13, the outer surface 40 of dielectric compound 38 may be in the shape of a hemisphere, and thus the terminal ends 32 of the discharge elements may extend to a virtual hemisphere to form an axisymmetric array 20. In other embodiments, as shown in FIG. 14, the terminal ends 32 of discharge elements 18 may extend to and be flush or even with the outer surface 40 of dielectric compound 38, which may be planar (i.e., which has or forms a plane at its surface), and thus the terminal ends 32 of the discharge elements 18 may extend to a virtual plane to form an axisymmetric array 20.

Figure 15:
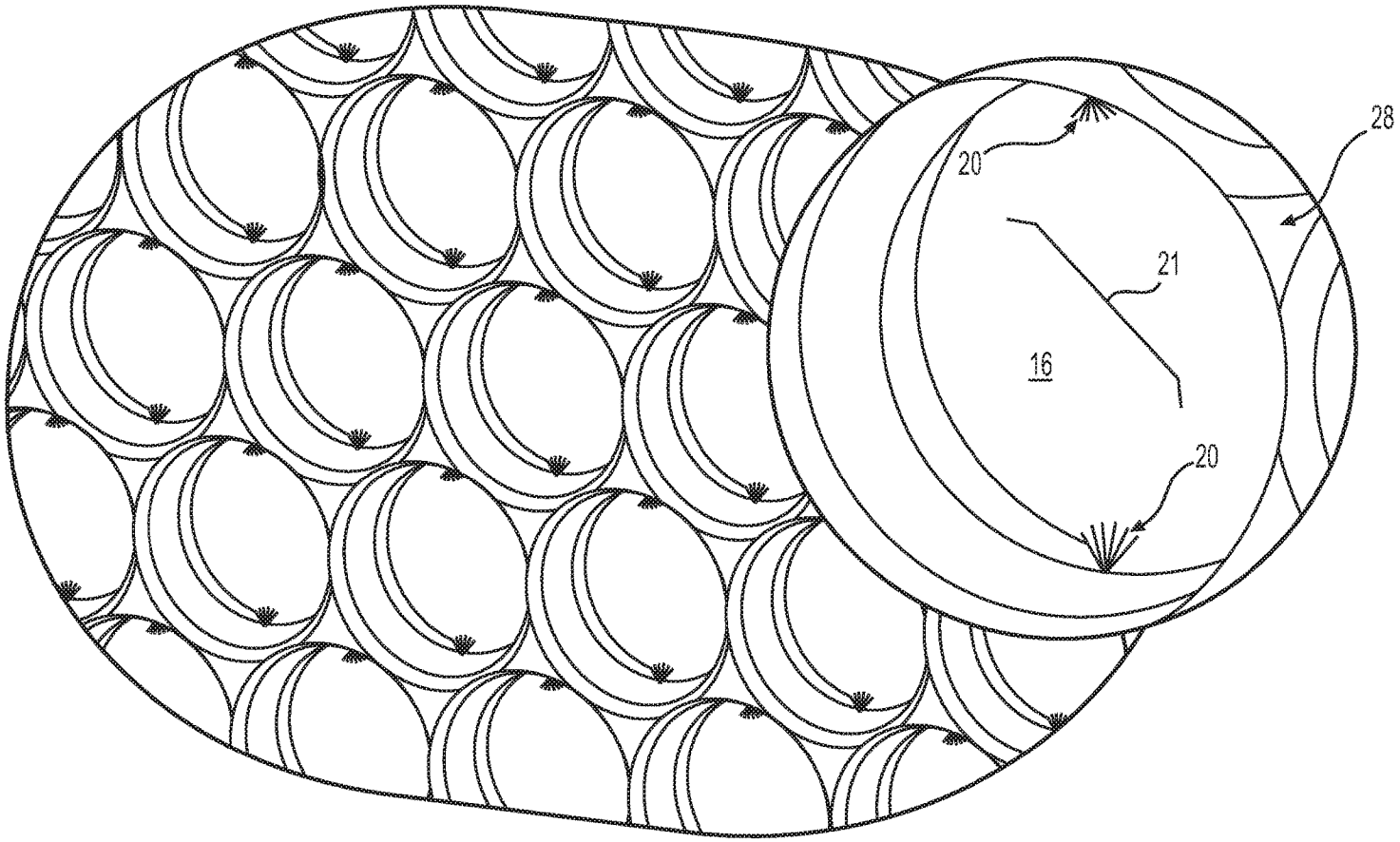
FIG. 15 is a cutaway view of a pair of electrodes having a flat array of discharge elements.

In some embodiments, as shown in FIG. 15, the axisymmetric arrays 20 of discharge elements 18 may be flat, i.e., comprised of discharge elements 18 positioned along a line or plane. Flat arrays 20 may include discharge elements that extend to a virtual plane, a virtual hemisphere, or other virtual shape. FIG. 15 shows multiple pairs 21 of flat axisymmetric arrays 20. However, it is to be appreciated that pairs 21 of axisymmetric arrays 20 may include two flat arrays, one flat array and one multi-dimensional array (i.e., an array having discharge elements extending along multiple axes), or two multi-dimensional arrays.

Figure 16:
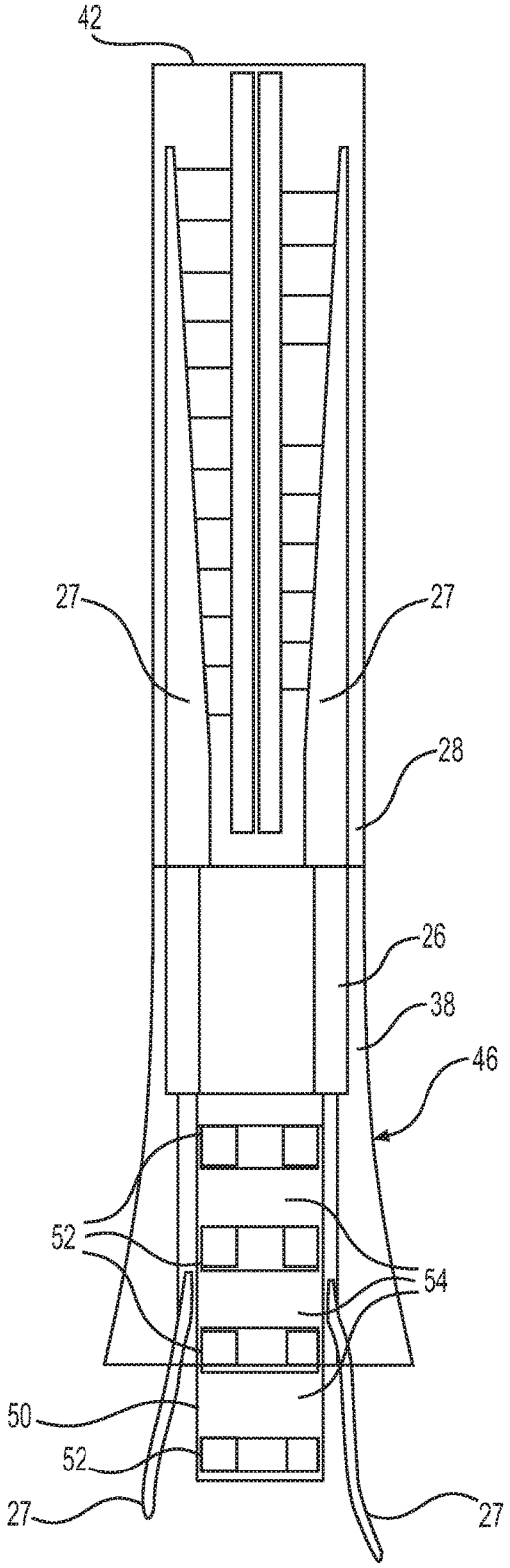
FIG. 16 is a cross-sectional view of an exemplary disclosed embodiment of an electro-acoustic transducer.
Figure 17:
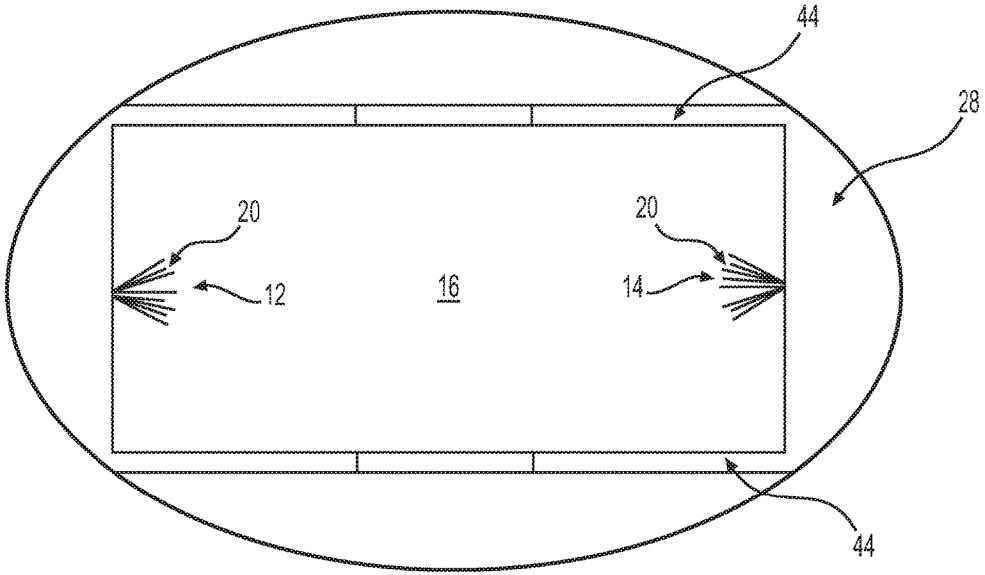
FIG. 17 is a cutaway view of an exemplary disclosed embodiment of the electroacoustic transducer of FIG. 16.

FIG. 16 shows a cross-sectional illustration of an exemplary electroacoustic transducer 42 consistent with embodiments of this disclosure. In some embodiments, a dielectric compound 38 may cover, enclose, or encase the current-limiting elements 26 of the electroacoustic transducer 42. The dielectric compound 38 may be a coating, a casting, assembly, or other form of dielectric compound or component. In some embodiments, as shown in FIG. 17, dielectric compound 38 may comprise dielectric barriers 44. Dielectric barriers 44 may be discrete pieces of dielectric material or components covered or coated with dielectric material. In other embodiments, the dielectric base 28 may form or be comprised of dielectric barriers 44.

Referring again to FIG. 16, in some embodiments, the electroacoustic transducer 42 may also include a radiator 46 configured to dissipate heat generated by the current-limiting elements 26. Radiator 46 may include fins or other structural elements formed of heat-conductive material, such as metal (e.g., aluminum, copper, etc.). Radiator 46 may be attached to or positioned near current-limiting elements 26 for dissipating heat energy generated by current limiting elements 26. In some embodiments, radiator 46 may include vents (e.g., holes, gaps, orifices, etc.) configured to promote airflow near or against other components of radiator 46 (e.g., the heat-conductive components) or current-limiting elements 26. In some embodiments, the electroacoustic transducer 42 may also include a fan (e.g., an electric fan) configured to move air or other fluid past radiator 12 and/or current-limiting elements 26.

In some embodiments, a sound-penetrable material 48 may at least partially surround a discharge area of electroacoustic transducer 42 to protect components of electroacoustic transducer 42 while permitting air to flow through during operation of the electroacoustic transducer 42. The discharge area may include an area or areas near or surrounding discharge elements 18 of the cathode 12 and anode 14 (referring to FIGS. 1-15 and 17) where acoustic waves are generated during the operation of the electroacoustic transducer 42. The sound-penetrable material may include cloth or other fabrics or materials (e.g., foam, mesh, screen, etc.).

In some embodiments, the electroacoustic transducer 42 may include a ventilation system 50 for circulating air or other fluid within the electroacoustic transducer. For example, ventilation system 50 may be configured to promote cooling of the electroacoustic transducer 42 (as explained above), to move fresh air into the electroacoustic transducer 42 for the ionization process, or to exhaust ionized air and/or byproducts of ionization from within electroacoustic transducer 42. For example, during operation of the electroacoustic transducer 42, diatomic oxygen molecules in the surrounding air may be split into valent oxygen atoms that may bond quickly with other diatomic oxygen molecules to produce ozone (03). To help mitigate the accumulation of ozone during operation of the electroacoustic transducer 42, the electroacoustic transducer 42 may also include ventilators 52, such as fans, for evacuating ozone from the discharge areas. The electroacoustic transducer 42 may also include one or more ozone-decomposing filter catalysts 54 for trapping particulates and reducing ozone into a different chemical composition. The ozone-decomposing filter catalyst 54 may include, for example, metal oxides (e.g., transition metal oxides, such as manganese oxide), noble metals, precious metals, and/or other materials for decomposing ozone.

Electroacoustic transducers consistent with this disclosure may operate as follows: When applying a potential difference (e.g., using voltage source 24) across the electrodes (e.g., cathode 12 and anode 14) having discharge elements with a large surface curvature (e.g., discharge elements 18), ions may be generated in areas near the electrodes (i.e., the discharge areas). Ions created during operation of the electroacoustic transducer may travel in the inter-electrode space 16 toward the electrode of opposite charge from itself. Continuous recombination of the ions may result in the generation of heat and excess neutral atoms in the in the inter-electrode space 16. As the ions travel to the oppositely charged electrode, they may collide with neutral atoms and molecules of gas (e.g., air) in the inter-electrode space 16. Thus, sound waves may be generated by three mechanisms of converting electrical energy into acoustic vibrations: the transfer of kinetic energy between the ions of neutral atoms and gaseous molecules; adiabatic heating of the gas during recombination of cations and anions; and changes in the number of neutral atoms in the inter-electrode space 16 due to their continuous generation, drift and recombination in the inter-electrode space 16.

Ions generated during this process may drift along electric field lines that are generated in the discharge areas. The inventor experimentally determined that the shape of the electrodes (e.g., of the arrays 20 and/or discharge elements 18) can affect the symmetry and homogeneity to the flow of ions and, when properly configured, can ensures that the spatial configuration of the electrode field and the ion-cloud field in the discharge area matches one another, thereby making the process of recombining ions in the inter-electrode space 16 symmetrical and uniform. As a result of the symmetrical and uniform ion recombination, the discharge process may be stabilized, thereby providing an advantage over known electroacoustic transducers.

Further, in the process of mass and energy transfer during ion generation, drift, and recombination, a local pressure increase in the inter-electrode space 16 may occur. Modulation of the electric potential across the electrodes (i.e., the cathode 12 and anode 14) may result in a corresponding modulation of the flow of ions and their energy, which may result in the modulation of pressure in the inter-electrode space 16. This pressure modulation may cause the formation or generation of spherical acoustic waves.

The inventor experimentally determined that shortcomings of known electroacoustic transducers may be attributed to a lack of discharge stability that is associated with the shape and configuration of discharge elements in known electroacoustic transducers.

Through experimentation, the inventor has discovered improved electrode shapes and configurations that result in a self-stabilizing effect of the electric field of the electrodes and ions, which enables an electroacoustic transducer system having twice as many electrodes (compared to known systems) to operate with high-quality results at power levels that would normally result in the occurrence of undesirable sparkover (i.e., uncontrolled spark discharge) in previously known systems (i.e., above 10 kV/cm).

Furthermore, the electrode shapes and configurations discovered by the inventor obviate the need to use dielectric partitions between discharge elements to prevent sparkover occurrences from destabilizing the discharge process, as was done in previously known electroacoustic transducer systems. Experiments conducted by the inventor have indicated that partitioning the discharge area (i.e., positioning dielectric partitions between discharge elements) as a means of preventing or reducing the negative effects sparkover, combined with the characteristics of the electrodynamic processes occurring in the inter-electrode space during the operation of the device, causes a violation of the natural spatial structure of the discharge process, and hence destabilization of the discharge process.

In known electroacoustic transducer systems, discharge elements extend into the inter-electrode space and produce areas of ion generation having rectangular cross-sections near the ends of the discharge elements. But experiments have shown that the cross-section of the discharge space degenerates from a rectangular shape into a circular shape as the distance from the discharge element into the inter-electrode space increases. It has been determined experimentally that known electroacoustic transducers experience discharge instability due to the changing form of the flow of ions as they drift from the electrode (i.e., from the discharge element) into the inter-electrode space. To mitigate this effect, known electroacoustic transducer systems required the use of dielectric partitions in close proximity to (within a few millimeters of) the discharge elements of the electrodes along the borders of the discharge area. However, dielectric barriers have a negative impact on the discharge process by (1) directly interacting with the ions, and (2) due to the effects of electrification and apparent surface conductivity resulting from dust accumulation and/or the condensation of moisture on the dielectric barrier surface.

The inventor has discovered through experimentation that configuring the electrodes in an axisymmetric array provides improved stabilization of the discharge process, greater efficiency, and greater acoustic capacity (i.e., the ability to generate acoustic waves at higher sound levels without reduced sound quality), than known electroacoustic transducers. Use of axisymmetric arrays has been shown through experimentation to require fewer pairs of electrodes (i.e., fewer independent sound-producing elements) to achieve a given sound level than known electroacoustic transducers. For example, a known electroacoustic transducer consisting of 72 pairs of electrodes was tested and was shown to produce an acoustic sound level of 90 dB/m at a frequency of 1 kHz. With the same supply of electrical power, a sound level of 90 dB/m at frequency of 1 kHz was achieved during experiments using an electroacoustic transducer having only 16 pairs of electrodes comprising axisymmetric arrays of discharge elements. Experiments also indicated that systems employing fewer electrode pairs with axisymmetric arrays of discharge elements could be operated at higher power levels than known electroacoustic transducer systems without the occurrence of sparkover.

The following examples provide non-limiting examples of electroacoustic transducers consistent with embodiments described above and other embodiments consistent with this disclosure.

Example 1

A first example of an electroacoustic transducer consistent with this disclosure is described with reference to FIGS. 1, 5, and 6. In this first example, an electroacoustic transducer may include two electrodes, including a cathode 12 and an anode 14, each consisting of a plurality of discharge elements 18. The discharge elements of the cathode 12 and anode 14 may be assembled into respective axisymmetric arrays 20 that share an axis of symmetry 22. The cathode 12 and anode 14 may be mounted on a dielectric base 28. The cathode 12 and anode 14 may be connected to a voltage source 24 by respective conductors 27. The voltage source 27 may be configured to provide a potential difference (i.e., a voltage) across the cathode 12 and anode 14 via respective conductors 27. The voltage potential may be modulated using a control signal, such as a sound input signal.

The voltage source 24 may be any type of electric device capable of creating and sustaining a voltage on the cathode 12 and anode 14 that is sufficient to produce bipolar corona discharge, and modulating the voltage, current, or power that generates the corona discharge based on the control signal. For example, the voltage source and modulation means may include vacuum tubes, transistors, key elements, transformers and/or combinations thereof, under the conditions of amplification, transformation, or modulation. For example, the voltage source and may include a vacuum-tube amplifier, a semiconductor amplifier, a step-up voltage transformer, or modulated voltage source.

During operation, the voltage is applied across the discharge elements with large surface curvature (i.e., the arrays 20 of discharge elements 18 of the cathode 12 and anode 14) or parts thereof, and ions may be formed in the near-electrode area (i.e., areas near the discharge elements 18 of the electrodes). The created ions may move along the lines of the electric field intensity from one electrode toward the other.

The electroacoustic transducer provides a highly-stabile discharge process, even when the voltage potential cross the electrodes is increased. The axisymmetric shape of the electrodes provides symmetry and homogeneity to the flow of ions during operation and ensures that the spatial configuration of the electrode field and the ion-cloud field in the discharge area matches one another. As a result, the process of recombining the ions is symmetrical and uniform in the inter-electrode space 16, thereby stabilizing the discharge process and improving the quality of sound generation. Additionally, in the process of mass and energy transfer that occurs during ion generation, ion drift, and the recombination of ions, a local pressure increase within the inter-electrode space 16 occurs. By modulating the flow of ions and their energy through modulation of the voltage potential across the electrodes (and thus the energizing electrical power), the pressure within the inter-electrode space 16 can be modulated to generate spherical acoustic waves.

Example 2

A second example consistent with this disclosure may be analogous to Example 1, wherein the active surface area of the cathode discharge elements is smaller than the active surface area of the anode discharge elements.

A device consistent with Example 2 may operate similarly to a device consistent with Example 1, wherein the smaller active surface area of the cathode discharge elements with respect to the anode discharge elements (as prescribed by this example) allows for increased control over the intensity of cation and anion generation. For example, during operation of a device consistent with this example, increasing the voltage potential across the electrodes may increase the discharge intensity instead of the size of the area of the discharge process, i.e., the active surface area (which is surrounded by glow of ionized gas) during operation. This configuration improves the linearization of the discharge process, thereby making it possible to increase the acoustic power of the electroacoustic transducer, while at the same time increasing the stability and quality of the generated acoustic waves.

Example 3

A third example consistent with this disclosure may be analogous to Example 1, wherein the axisymmetric arrays 20 of discharge elements 18 forming the cathode 12 or the anode 14 have a diameter not greater than 20 mm.

A device consistent with Example 3 may operate in a similar way as a device consistent with Example 1, wherein highly stabilized discharge is achieved during operation of the electroacoustic transducer through the implementation of electrodes formed of axisymmetric arrays of discharge elements having a cross-sectional length (e.g., a diameter) not greater than 20 mm.

Example 4

With reference to FIGS. 2, 3, 4, 16, a fourth example consistent with this disclosure may be analogous to a device consistent with Example 1, wherein one or both of the respective circuit portions 29, 31 connecting cathode 12 and anode 14 to the voltage source 24 includes a current-limiting element 26, such as a resistor. In other words, the cathode 12, the anode 14, or both the cathode 12 and the anode 14 may be connected to the voltage source 24 through a current limiting element 26, such as a resistor.

A device consistent with Example 4 may operate similarly to a device consistent with Example 1, wherein the current-limiting element 26 provides protection against the occurrence of an uncontrolled arc caused by a sudden overvoltage, thereby enabling the electro acoustic transducer to be effectively operated at various power levels and in various environments conditions without the risk of undesired arcing.

Example 5

With reference to FIGS. 9, 10, 11, 12, 13, 14, a fifth example consistent with this disclosure may be analogous to Example 1, wherein the discharge elements 18 are implemented as discrete conducting bodies, e.g., wires embedded in the dielectric compound 38, such that the terminal ends 32 of the discharge elements 18 are flush or level with the surface 40 of the dielectric compound 38 or extend some distance therefrom.

A device consistent with Example 5 may operate similarly to a device consistent with Example 1, wherein the dielectric compound 38 provides a more rigid fixation of the discharge elements 18, thereby increasing the durability and reliability of the device, minimizing the dust accumulation rate between the discharge elements 18 in the arrays 20, and simplifying the installation and removal processes of the arrays 20. In this way, implementation of the dielectric compound 38, as described herein above, improves the operating characteristics of the device and provides greater flexibility in design and manufacturing/assembly processes.

Example 6

With reference to FIGS. 7, 8, 11, 12, 13, a sixth example consistent with this disclosure may be analogous to a device consistent with Example 1, wherein the arrays 20 of discharge elements 18 are implemented such that the terminal ends 32 of the discharge elements 18 extend to a virtual shape, such as virtual hemisphere 36. In other embodiments, other types of virtual shapes may be used, such as other shapes resulting in an axisymmetric curved virtual surface. By this arrangement, the increased distance between electrodes from the center to periphery of the arrays 20 may define a smooth and uniform decrease of the intensity of the electric field from the center of the corresponding arrays 20 to the periphery of the corresponding arrays 20 during operation and may prevent negative impacts of edge effects upon the stability of the discharge process.

A device consistent with Example 6 may operate similarly to a device consistent with Example 1, wherein a distance between the terminal ends 32 of the discharge elements 18 of the cathode 12 and the anode 14 increases from the center of each corresponding array 20 to the periphery of each corresponding array. This increase in distance between electrodes from the center to periphery of the arrays 20 may define a smooth and uniform decrease of the intensity of the electric field from the center of the corresponding arrays 20 to the periphery of the corresponding arrays 20 during operation and may prevent negative impacts of edge effects upon the stability of the discharge process.

Example 7

A seventh example consistent with this disclosure may be analogous to devices consistent with Example 1, wherein the discharge elements 18 of the electrodes (i.e., the cathode 12 and anode 14) form or partially define three-dimensional bodies. In some embodiments, the three-dimensional bodies may have an axial symmetry. For example, a plurality of discharge elements 18 may form or partially define a hemispherical shape or other convex shape with axial symmetry. The size (i.e., length, width, diameter, etc.) of discharge elements 18 that form or partially define the three-dimensional bodies may be in the macro (i.e., greater than micro), micro, or nano ranges.

A device consistent with Example 7 may operate similarly to a device consistent with Example 1, wherein the geometry of the discharge elements 18 of the anode 14 is simplified with respect to known devices, thereby improving the operational characteristics of the device (i.e., achieving the benefits explained above) and providing greater flexibility in design and manufacturing/assembly processes.

Example 8

An eighth example consistent with this disclosure may be analogous to a device consistent with Example 1, wherein the discharge elements 18 of the cathode 12, the anode 14, or both the cathode 12 and the anode 14, are implemented as parts of a solid three-dimensional body with conductive and dielectric areas on its surface. For example, terminal ends 32 of discharge elements and surface 40 of the dielectric compound may be configured to form or partially define the surface of a three-dimensional body (e.g., a hemispherical body or other shaped body), thereby providing a surface having conductive and dielectric areas.

A device consistent with Example 8 may operate similarly to a device consistent with Example 1, wherein the alternating conductive and dielectric areas of the discharge elements 18 permits the use of dielectric compounds 38 having more complex geometry, as well as resulting discharge areas having more complex geometry. Additionally, the electrodes may include microscopic discharge elements 18 configured to increase the efficiency and stability of the discharge process and improve the performance characteristics of the device while providing greater flexibility in design and manufacturing/assembly processes.

Example 9

A ninth example consistent with this disclosure may be analogous to a device consistent with Example 1, wherein the discharge elements 18 are formed of corrosively inert and/or electrochemically inert materials, such as the platinum-group metals, metal oxides, and other materials traditionally used in gas-discharge technology.

A device consistent with Example 9 may operate similarly to a device consistent with Example 1, wherein the corrosively inert and/or electrochemically inert materials of the electrodes enable the electrodes to be resistant to physical and chemical changes, especially at their surfaces, under the conditions of a corona discharge, thereby prolonging the operational lifespan of the discharge elements 18.

Example 10

A tenth example consistent with this disclosure may be analogous to a device consistent with Example 1, wherein the discharge elements 18 are formed of a material or materials having a low and/or high electron work function.

A device consistent with Example 10 may operate similarly to a device consistent with Example 1, wherein the use of materials with a high or low electron work function provides an increase or decrease in the intensity of ion generation, as well as an increase or decrease in the ion energy level, thereby providing additional stabilization and intensification of the discharge process. A high electron work function may be an electron work function equal to or greater than 4.5 eV. A low electron work function may be an electron work function less than 4.5 eV.

Example 11

An eleventh example consistent with this disclosure may be analogous to a device consistent with Example 1, wherein the cathode 12 and the anode 14, which may be formed of a plurality of electrode pairs 21, are configured as elementary speakers (i.e., sound-producing devices) fastened to the dielectric base 28. The electrode pairs be further electrically isolated from one another by the dielectric barriers 44, as shown in FIGS. 16 and 17. In some embodiments, the dielectric base 28 itself may serve as a dielectric barrier that separates electrode pairs 21, as shown in FIG. 15.

A device consistent with Example 11 may operate similarly to a device consistent with Example 1, wherein dielectric barriers 44 prevent the occurrence of a cross-discharge between pairs of electrodes, which ensures the stability of the discharge process during operation and improves the efficiency of the current-limiting element. Dielectric barriers 44 may also enable the implementation of a three-dimensional structure of the cathode 12 and anode 14 for achieving an acoustic field of desired parameters.

It is to be appreciated that in any of the embodiments described herein, electrode pairs 21 may be positioned in any manner in which sufficient separation between the cathode 12 and anode 14 exists to enable the generation of acoustic waves with sufficient quality. That is, the positioning of the cathode and anode portions of each electrode pair 21 may is not necessarily limited to a particular spacing or configuration shown in any of the disclosed embodiments. For example, in some embodiments, the cathode and anode portions may be positioned on an actual or virtual surface, such as a plane, a sphere, etc.

Example 12

A twelfth embodiment consistent with this disclosure may be analogous to a device consistent with Example 1, wherein the discharge elements 18 are mounted near or inside a reflector, horn, cone, or other device configured for reflecting, guiding, or focusing acoustic waves.

A device consistent with Example 12 may operate similarly to a device consistent with Example 1, wherein the use of a reflector, horn, or other such device enables the control of sound field parameters by localizing the sound radiation in a spatial area, thereby increasing the volume of the generated sound. The illustration does not reflect a traditional design diagram for the acoustic use of the reflector or horn, for the purpose of not overwhelming the application materials.

Example 13

Figure 18:
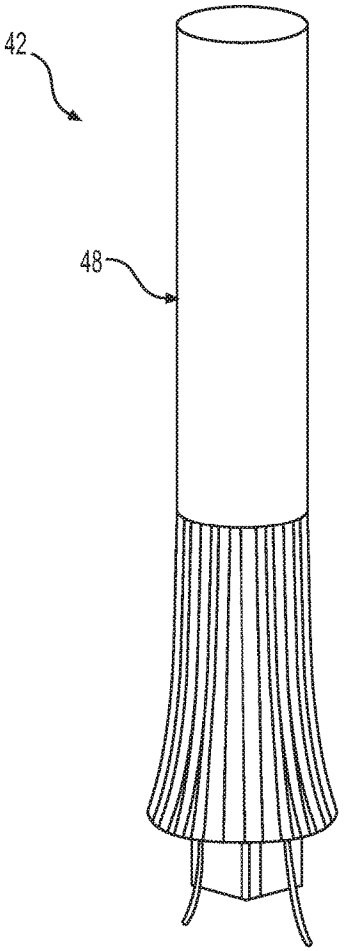
FIG. 18 is a perspective view illustration of an exemplary disclosed embodiment of an electro-acoustic transducer.

A thirteenth example consistent with this disclosure may implement one or more devices consistent with Example 1 in an electroacoustic transducer 42, as shown in FIG. 18. The electroacoustic transducer 42 of FIG. 18 may comprise a dielectric base 28 and axisymmetric arrays 20 of discharge elements 18 fastened thereto (as shown, for example, in FIG. 16). The arrays 20 of discharge elements 18 may be surrounded by a sound-penetrable cover 48, such as a cloth, a screen, a grate, foam, etc.

A device consistent with Example 13 may operate similarly to a device consistent with Example 1, wherein the sound-penetrable material 48 is configured to retain ozone produced during the ion generation process by hindering its release into the environment and retaining it for further processing.

Example 14

With reference to FIGS. 16 and 18, a fourteenth example may be analogous to a device consistent with Example 12, wherein the device is an electroacoustic transducer 42 consisting of a dielectric base 28 and arrays 20 of discharge elements 18 fastened thereto, the assembly further comprising a ventilation system 50.

A device consistent with Example 14 may operate similarly to in Example 1, wherein the ventilation system 50 is configured to generate air flow through the electro-acoustic transducer, which is formed by pairs of electrodes, i.e., a cathode 12 and an anode 14 fastened to the dielectric base 28. The ventilation system may be configured to remove heat released by the process of ionization and recombination of ions from the inter-electrode space 16, thereby preventing air and structural elements within the assembly from overheating when the device is operated a power levels high enough to generate corona discharge.

Example 15

With reference to FIGS. 16, 17, and 18, a fifteenth example consistent with this disclosure may be analogous to a device consistent with Example 14, wherein the electroacoustic transducer that consists of a dielectric base 28 and arrays 20 of discharge elements 18 fastened thereto and a ventilation system 50, further comprises an ozone-decomposing filter catalyst 54.

A device consistent with Example 15 may operate similarly to a device consistent with Example 1, wherein the ventilation system 50 may be configured to create an airflow through the electro-acoustic transducer 42 comprising pairs 21 of electrodes (i.e., cathode 12 and anode 14 pairs) fastened to the dielectric base 28, wherein the ventilation system 50 is configured to allow air containing ozone to pass through the ozone-decomposing filter catalyst 54.

It will be apparent to those skilled in the art that various modifications and variations can be made to the disclosed devices and systems without departing from the scope of the disclosure. Other embodiments of the disclosed devices and systems will be apparent to those skilled in the art from consideration of the specification and practice of the systems and devices disclosed herein. It is intended that the specification and examples be considered as exemplary only, with a true scope being indicated by the following claims and their equivalents.

What is claimed is:

1. An electroacoustic transducer for generating an acoustic signal when connected to a voltage source, the transducer comprising:

a cathode having a plurality of cathode discharge elements arranged into an array of cathode discharge elements disposed around an axis associated with the cathode;

an anode having a plurality of anode discharge elements arranged into an array of anode discharge elements disposed around an axis associated with the anode;

an inter-electrode space separating the cathode and the anode; and a current-limiting element configured to limit current supplied to at least one of the cathode or the anode when connected to the voltage source, wherein the cathode discharge elements and the anode discharge elements extend toward the inter-electrode space, wherein the respective arrays of the cathode and anode are opposite of each other with respect to the inter-electrode space and are axisymmetric such that the cathode axis is aligned with the anode axis, and wherein at least one of the cathode and anode is configured to generate the acoustic signal when connected to the voltage source through the current-limiting element.

2. The electroacoustic transducer of claim 1, wherein the current-limiting element is connected to one of the cathode and the anode.

3. The electroacoustic transducer of claim 1, wherein:

the current-limiting element is connected to one of the cathode and the anode; and the electroacoustic transducer further comprises a second current-limiting element connected to the other one of the cathode and the anode.

4. The electroacoustic transducer of claim 1, wherein the discharge elements of the cathode and anode comprise a material having a work function no greater than 4.5 eV.

5. The electroacoustic transducer of claim 1, wherein:

the discharge elements of the cathode and anode are mounted on a respective dielectric base; and the discharge elements of the cathode and anode each extend from the respective dielectric base to a respective terminal end, wherein the terminal ends of the cathode discharge elements are located within a first virtual plane and wherein the terminal ends of the anode discharge elements are located within a second virtual plane.

6. The electroacoustic transducer of claim 5, wherein the terminal ends of the cathode discharge elements are located at the same normal distance from a surface of the respective dielectric base to the first virtual plane.

7. The electroacoustic transducer of claim 5, wherein the terminal ends of the anode discharge elements are located at the same normal distance from a surface of the respective dielectric base to the second virtual plane.

8. The electroacoustic transducer of claim 5, wherein the terminal ends of the cathode discharge elements are located at different normal distances from the surface of the respective dielectric base to the first virtual plane.

9. The electroacoustic transducer of claim 5, wherein the terminal ends of the anode discharge elements are located at different normal distances from the surface of the dielectric base to the second virtual plane.

10. The electroacoustic transducer of claim 1, wherein the discharge elements of the cathode and anode each extend toward the inter-electrode space to terminate at a respective terminal end, wherein the terminal ends of the cathode and anode are located within a respective virtual hemisphere.

11. The electroacoustic transducer of claim 1, wherein:

the discharge elements of the cathode and anode are mounted to a dielectric base and extend from a surface of the dielectric base toward the inter-electrode space.

12. The electroacoustic transducer of claim 1, wherein the discharge elements of the cathode and anode are mounted to a respective dielectric base and extend toward the inter-electrode space to terminate at respective terminal ends, the terminal ends being flush with a surface of the respective dielectric base.

13. The electroacoustic transducer of claim 12, wherein the surface of the dielectric base comprises a plane.

14. The electroacoustic transducer of claim 13, wherein the discharge elements of the cathode and anode extend toward the inter-electrode space at an angle greater than zero degrees with respect to the cathode axis and the anode axis, respectively.

15. The electroacoustic transducer of claim 12, wherein the surface of the respective dielectric base comprises a curved surface.

16. The electroacoustic transducer of claim 15 wherein the discharge elements of the cathode and anode extend toward the inter-electrode space in a normal direction with respect to curved surface.

17. The electroacoustic transducer of claim 15, wherein the curved surface comprises a hemisphere.

18. The electroacoustic transducer of claim 1, wherein the cathode discharge elements and the anode discharge elements are configured to generate an ion discharge when connected to the voltage source.

19. The electroacoustic transducer of claim 1, wherein the cathode discharge elements and the anode discharge elements are electrically conductive.

20. The electroacoustic transducer of claim 1, wherein the anode discharge elements and cathode discharge elements produce ozone when connected to the voltage source, and wherein the transducer further includes a sound-penetrable material that at least partially surrounds the cathode discharge elements and anode discharge elements and is configured to retain the ozone.

* * * * *